US010476182B2

(12) United States Patent
Horio et al.

(10) Patent No.: US 10,476,182 B2
(45) Date of Patent: Nov. 12, 2019

(54) MOLDED PORTION-EQUIPPED ELECTRICAL WIRE

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Hitoshi Horio, Yokkaichi (JP); Kouji Fukumoto, Yokkaichi (JP); Daisuke Hashimoto, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRICAL INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/093,900

(22) PCT Filed: Mar. 28, 2017

(86) PCT No.: PCT/JP2017/012606
§ 371 (c)(1),
(2) Date: Oct. 15, 2018

(87) PCT Pub. No.: WO2017/179410
PCT Pub. Date: Oct. 19, 2017

(65) Prior Publication Data

US 2019/0131725 A1 May 2, 2019

(30) Foreign Application Priority Data

Apr. 13, 2016 (JP) ..... 2016-080028

(51) Int. Cl.
*H01R 4/70* (2006.01)
*H01R 4/72* (2006.01)
*H01R 11/12* (2006.01)

(52) U.S. Cl.
CPC ..... *H01R 4/70* (2013.01); *H01R 4/72* (2013.01); *H01R 11/12* (2013.01)

(58) Field of Classification Search
CPC ..... H01R 4/72; H01R 4/70; H01R 11/12
(Continued)

(56) References Cited

U.S. PATENT DOCUMENTS 4,118,097 A * 10/1978 Budnick ..... H01M 2/206 439/387
5,137,478 A * 8/1992 Graf ..... H01R 4/723 174/84 R
(Continued)

FOREIGN PATENT DOCUMENTS

JP 2008-258103 A 10/2008
JP 2013-187041 A 9/2013
(Continued)

OTHER PUBLICATIONS

Jun. 20, 2017 International Search Report issued in International Patent Application No. PCT/JP2017/012606.

*Primary Examiner* — Briggitte R. Hammond
(74) *Attorney, Agent, or Firm* — Oliff PLC

(57) ABSTRACT

A molded portion-equipped electrical wire that includes a conductor; a terminal connected to an end of the conductor; a mold covering a portion at which the conductor and the terminal are connected such that the terminal protrudes from one end side of the mold and the conductor protrudes from another end side of the mold; an insulating covering that covers a periphery of the mold and the conductor and is obtained due to a thermal contraction tube contracting; and a body that is provided on an outer circumferential surface
(Continued)

of the mold and includes a level difference forming surface facing the one end side, wherein an end of the covering is caught on a level difference portion formed by the level difference forming surface, and the body is made of an elastic material.

12 Claims, 4 Drawing Sheets

(58) Field of Classification Search
USPC ..... 439/270, 271
See application file for complete search history.

(56) References Cited

U.S. PATENT DOCUMENTS 7,959,464 B2 * 6/2011 Mizutani ..... H01R 13/504 439/588
8,480,421 B2 * 7/2013 Yoshioka ..... H01R 43/24 439/275
9,312,647 B2 * 4/2016 Bechstein ..... H01R 4/023
9,564,690 B2 * 2/2017 Kondo ..... H01R 4/70
9,634,538 B2 * 4/2017 Smith ..... H02K 5/225
10,065,342 B2 * 9/2018 Hirooka ..... B29C 33/12
10,122,097 B2 * 11/2018 Kim ..... H01R 13/405
10,319,497 B2 * 6/2019 Hirooka ..... H01R 4/72
2002/0102872 A1 * 8/2002 Kanagawa ..... H01R 9/0524 439/98
2002/0177373 A1 * 11/2002 Shibata ..... H01R 33/765 439/894
2003/0236016 A1 * 12/2003 Murakami ..... H01B 7/0081 439/212
2012/0318575 A1 * 12/2012 Koto ..... H01R 4/72 174/84 C
2013/0052848 A1 * 2/2013 Sloey ..... H01R 13/52 439/271
2013/0126234 A1 * 5/2013 Ono ..... H01R 4/72 174/75 R
2015/0047900 A1 * 2/2015 Suetani ..... H02G 15/046 174/77 R
2015/0111442 A1 * 4/2015 Miyamoto ..... H01R 4/62 439/874
2016/0294107 A1 * 10/2016 Trimborn ..... H01R 4/30

FOREIGN PATENT DOCUMENTS

JP 2015-135793 A 7/2015
JP 2016-046911 A 4/2016
JP 2017-021979 A 1/2017

* cited by examiner

MOLDED PORTION-EQUIPPED ELECTRICAL WIRE

This application is the U.S. National Phase of PCT/JP2017/012606 filed Mar. 28, 2017, which claims priority from JP 2016-080028 filed Apr. 13, 2016, the entire disclosure of which is incorporated herein by reference.

BACKGROUND

The present disclosure relates to a molded portion-equipped electrical wire including a molded portion and a terminal-equipped electrical wire.

For example, JP 2013-187041A discloses a molded portion-equipped electrical wire including: a terminal-equipped electrical wire with a terminal connected to an end portion of an insulated electrical wire including a conductor and an insulating covering; and a molded portion that covers the insulated electrical wire and the terminal.

SUMMARY

However, in the example shown in JP 2013-187041A, a step of removing the insulating covering of the end portion of the insulated electrical wire is needed when manufacturing a molded portion-equipped electrical wire.

An exemplary aspect of the disclosure aims to eliminate the need for a step of removing the insulating covering in a molded portion-equipped electrical wire including an insulated conductor.

In order to solve the above-described problem, a molded portion-equipped electrical wire according to a first aspect includes: a conductor; a terminal connected to an end of the conductor; a mold covering a portion at which the conductor and the terminal are connected such that the terminal protrudes from one end side of the mold and the conductor protrudes from another end side of the mold; an insulating covering that covers a periphery of the mold and the conductor and is obtained due to a thermal contraction tube contracting; and a body that is provided on an outer circumferential surface of the mold and includes a level difference forming surface facing the one end side, wherein an end of the covering is caught on a level difference portion formed by the level difference forming surface, and the body is made of an elastic material.

In a molded portion-equipped electrical wire according to a second aspect, the body fits into a positioning recess formed in the outer circumferential surface of the mold.

In a molded portion-equipped electrical wire according to a third aspect, the body is formed separately from the mold and is attached to the outer circumferential surface of the mold.

A molded portion-equipped electrical wire according to a fourth aspect is the molded portion-equipped electrical wire according to any one of the first to third aspects, further including an adhesion that is provided on the periphery of the body and fills a space between the covering and the body and a space between the mold and the body.

A molded portion-equipped electrical wire according to a fifth aspect is the molded portion-equipped electrical wire according to any one of the first to fourth aspects, wherein the body is formed into a ring shape so as to be continuous over the entire circumferential direction.

A molded portion-equipped electrical wire according to a sixth aspect is the molded portion-equipped electrical wire according to any one of the first to fifth aspects, wherein a gap is formed between the conductor and the covering.

According to the first to sixth aspects, a covering that covers the periphery of the mold and the conductor is formed by heating a thermal contraction tube in a state in which the mold and the conductor have been passed through the thermal contraction tube. In this case, the conductor is insulated by the covering. Here, the end of the covering is caught on the level difference portion. For this reason, positional misalignment of the covering with respect to the conductor can be suppressed, and the conductor can be more reliably insulated by the covering. Accordingly, even if the end of the naked conductor and the terminal are connected without using the insulated electrical wire with an insulated and covered conductor, the conductor can be more reliably insulated by the covering. According to the above, it is possible to eliminate the need for a step of removing the insulating covering in the molded portion-equipped electrical wire including the insulated conductor.

In particular, according to the second aspect, it is possible to achieve stabilization of the product quality by being able to prevent the body from becoming misaligned with respect to the mold or the orientation from curving, during contraction of the thermal contraction tube or the like.

In particular, according to the fourth aspect, it is possible to more reliably waterproof the space between the covering and the body, and the space between the mold and the body, by including an adhesion.

In particular, according to the first aspect, it is possible to easily retrofit the body, even if the outer dimension of one end side of the mold is greater than that of a portion of the mold at which the body is provided. Also, if the body is provided in an expanded state, it is possible to more reliably waterproof the space between the mold and the body due to the body squeezing the mold.

In particular, according to the fifth aspect, the number of components can be suppressed to a lower number compared to the case where the level difference forming portion is two or more components.

In particular, according to the sixth aspect, since a gap is formed between the conductor and the covering, the conductor can be made more bendable.

DETAILED DESCRIPTION OF EMBODIMENTS

Embodiment

Figure 1:
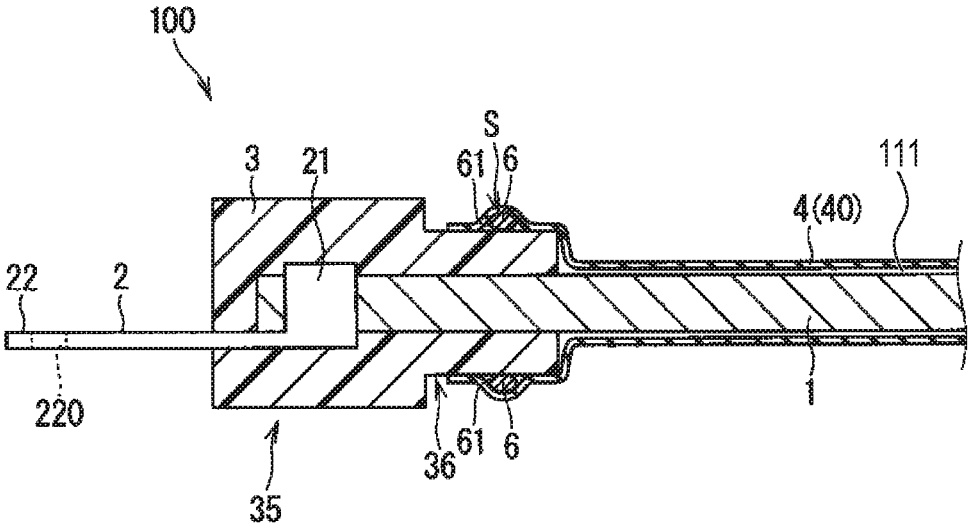
FIG. 1 is a partial cross-sectional view of a molded portion-equipped electrical wire according to an embodiment.
Figure 2:
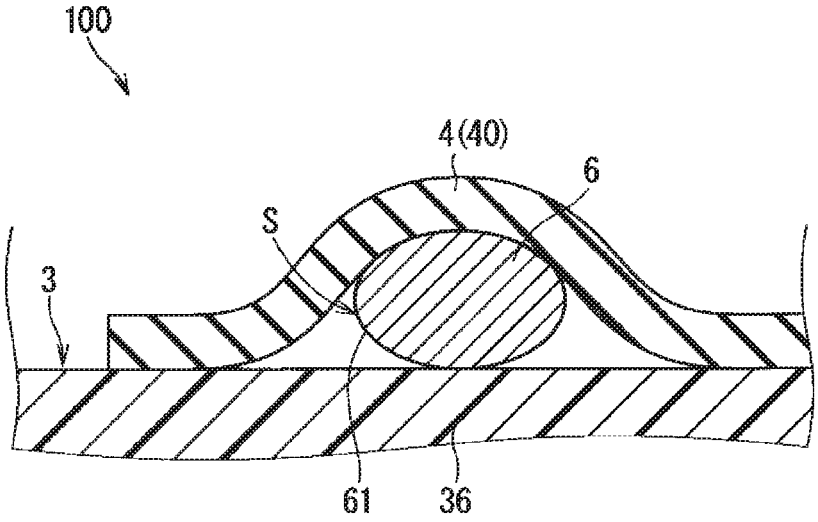
FIG. 2 is an enlarged cross-sectional view of part of a molded portion-equipped electrical wire according to an embodiment.
Figure 3:
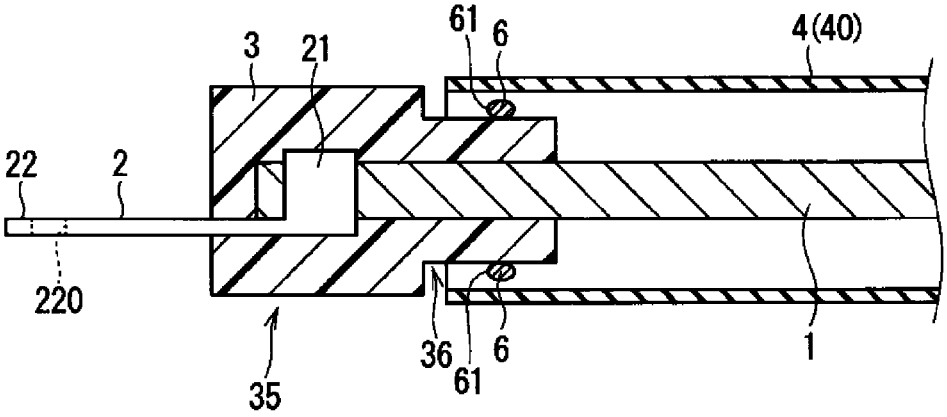
FIG. 3 is an illustrative diagram illustrating a method for manufacturing a molded portion-equipped electrical wire according to an embodiment.

Hereinafter, a molded portion-equipped electrical wire according to an embodiment will be described. FIG. 1 is a partial cross-sectional view of a molded portion-equipped electrical wire 100 according to an embodiment. FIG. 2 is an enlarged cross-sectional view of the molded portion-equipped electrical wire 100 according to the embodiment. FIG. 3 is an illustrative diagram illustrating a method for manufacturing the molded portion-equipped electrical wire 100 according to the embodiment.

The molded portion-equipped electrical wire 100 includes a conductor portion 1 ("conductor"), a terminal 2, a molded portion 3 ("mold"), a covering portion 4 ("covering"), and a level difference forming member 6 ("body"). Also, the end portion of the covering portion 4 is caught on a level difference portion S formed by the level difference forming member 6. The molded portion-equipped electrical wire 100 is included in a wire harness mounted in a vehicle such as an automobile, for example.

The conductor portion 1 of the molded portion-equipped electrical wire 100 will be described first. The conductor portion 1 is a linear metal member. For example, the conductor portion 1 is a linear member whose main component is a metal such as copper or aluminum.

Also, in the present embodiment, the conductor portion 1 is a flexible member that can bend. It is conceivable that the conductor portion 1 is a twisted wire obtained by twisting together multiple strands, a braided wire obtained by braiding multiple strands, or the like. Note that the conductor portion 1 may be a single-core wire or the like, and may be a member whose linear shape is maintained.

The conductor portion 1 is naked during the manufacture of the molded portion-equipped electrical wire 100. Here, the terminal 2 is connected to the end portion of the naked conductor portion 1, and thereafter, the periphery of the conductor portion 1 is covered by the covering portion 4. This will be described in detail later.

Next, the terminal 2 will be described. The terminal 2 is connected to the end portion of the conductor portion 1. Accordingly, the conductor portion 1 and the terminal 2 are electrically connected. For example, the terminal 2 is a member whose main component is a metal such as copper.

In the present embodiment, as shown in FIG. 1, the terminal 2 includes a first connection portion 21 that is connected to the end portion of the conductor portion 1 and a second connection portion 22 that can connect to a partner-side member, which is a connection partner of the terminal 2.

Here, the first connection portion 21 includes a crimped piece that can be crimped onto the end portion of the conductor portion 1. In the molded portion-equipped electrical wire 100, the crimped piece of the first connection portion 21 is crimped in a state of covering the periphery of the end portion of the conductor portion 1. Note that it is also conceivable that the first connection portion 21 is connected to the conductor portion 1 through welding, such as thermal welding or ultrasonic welding. In this case, it is conceivable that the first connection portion 21 is formed into a flat shape according to which the end portion of the conductor portion 1 can be welded, for example.

Also, here, the second connection portion 22 is provided with a fastening hole 220 that enables bolt fastening to the partner-side member. Note that for example, a terminal platform or the like is conceivable as the partner-side member of the connection partner of the terminal 2.

Next, the molded portion 3 will be described. The molded portion 3 covers the portion at which the conductor portion 1 and the terminal 2 are connected, such that the terminal 2 protrudes from one end side of the molded portion 3 and the conductor portion 1 protrudes from the other end side of the molded portion 3. More specifically, the molded portion 3 covers the end portion of the conductor portion 1 and the first connection portion 21 of the terminal 2.

For example, the molded portion 3 is insert-molded so as to cover the portion at which the conductor portion 1 and the terminal 2 are connected, with the conductor portion 1 and the terminal 2 being used as insert components. As the resin for forming the molded portion 3, it is conceivable to use PBT (polybutylene terephthalate) resin, PPS (polyphenylene sulfide) resin, PPA (polyphthalamide) resin, LCP resin (liquid crystal polymer), phenol-based, polyester-based, polyamide-based, or epoxy-based resin, or the like.

In the molded portion-equipped electrical wire 100, the terminal 2 protrudes from one end side of the molded portion 3. More specifically, the second connection portion 22 of the terminal 2 protrudes from the one end side of the molded portion 3. On the other hand, the conductor portion 1 protrudes from the other end side of the molded portion 3. More specifically, the portion other than the end portion of the conductor portion 1 protrudes from the other end side of the molded portion 3.

Here, as shown in FIG. 1, the molded portion 3 includes a first portion 35 that forms a portion on one end side that covers the portion at which the conductor portion 1 and the terminal 2 are connected, and a second portion 36 that protrudes from the first portion 35 to the conductor portion 1 side and forms a portion on the other end side. As shown in FIG. 1, the second portion 36 is also a portion that covers the periphery of only the conductor portion 1. Also, the second portion 36 has an outer diameter smaller than that of the first portion 35. Of course, the first portion 35 and the second portion 36 may have the same diameter, or the second portion 36 may have the larger diameter. Also, here, the extension direction of the molded portion 3 coincides with the extension direction of the conductor portion 1.

As shown in FIG. 1, the level difference forming member 6 is provided on the outer circumferential surface of the molded portion 3. In the present embodiment, the level difference forming member 6 is provided on the outer circumferential surface of the second portion 36 of the molded portion 3. The level difference forming member 6 includes a level difference forming surface 61 that faces the one end side. Accordingly, the level difference portion S is formed on the outer circumferential side of the molded portion 3. That is, the level difference portion S is formed due to the level difference forming member 6 being provided on the outer circumferential surface of the molded portion 3. The level difference portion S is formed in a protruding manner such that a portion on the other end side with respect to the level difference forming surface 61 exists outward in the radial direction of the molded portion 3 with respect to the portion on the one end side with respect to the level difference forming surface 61. Here, the level difference portion S is formed in a protruding manner such that the portion of the level difference forming member 6 that is continuous with the outer circumferential side portion of the level difference forming surface 61 exists on the outer circumferential side with respect to the outer circumferential surface of the second portion 36.

Here, for example, the level difference forming member 6 is made of an elastic material such as rubber. Also, the level difference forming member 6 is formed into a ring shape so as to be continuous over the entire circumferential direction. In the present embodiment, the level difference forming member 6 is formed into a continuous circular ring shape using an elastic member, as with an O-ring. Accordingly, here, the level difference forming surface 61 forms a semi-circular arc-shaped surface. Also, there is no portion included on the level difference forming member 6 on the one end side with respect to the level difference forming surface 61. Here, the level difference portion S is formed due to the outer circumferential surface of the level difference forming member 6 protruding outward in the radial direction of the molded portion 3 with respect to the outer circumferential surface of the molded portion 3 located on the one end side with respect to the level difference forming member 6. The level difference portion S of the present embodiment is formed along the outer circumferential surface of the molded portion 3 (second portion 36) and the level difference forming surface 61.

In the present embodiment, the end portion of the covering portion 4 is caught on the level difference portion S. It is preferable that the level difference portion S includes a surface orthogonal to the extension direction of the molded portion 3 or a surface that inclines to one end side as the outer circumferential side is approached, as with the surface on the inner circumferential side (molded portion 3 side) of the level difference forming surface 61. The purpose of this is to make it easier for the end portion of the covering portion 4 to be caught thereon.

The inner circumferential surface of the level difference forming member 6 and the outer circumferential surface of the portion of the second portion 36 on which the level difference forming member 6 is provided are preferably formed into analogous shapes. For example, it is conceivable that both the outer circumferential surface of the second portion 36 and the inner circumferential surface of the level difference forming member 6 are formed into circular shapes, rectangular shapes, or the like. Accordingly, the level difference forming member 6 more easily comes into close contact with the second portion 36, and it is possible to improve the waterproofing property. Also, the inner diameter of the level difference forming member 6 is preferably formed equal to or smaller than the outer diameter of the portion of the second portion 36 on which the level difference forming member 6 is provided. Accordingly, a gap is less likely to be formed between the level difference forming member 6 and the second portion 36, and it is possible to improve the waterproofing property. In particular, if the inner diameter of the level difference forming member 6 is formed smaller than the outer diameter of the portion of the second portion 36 on which the level difference forming member 6 is provided, the level difference forming member 6 squeezes the second portion 36 due to the level difference forming member 6 being provided on the second portion 36 in a state of being elastically deformed so as to expand. Accordingly, it is possible to improve the waterproofing property.

Next, the covering portion 4 will be described. In the molded portion-equipped electrical wire 100, the covering portion 4 covers the periphery of the molded portion 3 and the conductor portion 1. More specifically, here, the covering portion 4 covers the periphery of the other end side (second portion 36) of the molded portion 3 and the conductor portion 1 extending out from the second portion 36.

Also, the covering portion 4 is an insulating member obtained due to the thermal contraction tube 40 contracting. For example, the thermal contraction tube 40 is a tube-shaped member composed of a synthetic resin, such as polyolefin-based, nylon-based, silicone-based, phosphorous resin-based, or polyester elastomer-based resin. The thermal contraction tube 40 is obtained due to the resin member formed into a thin tube shape through extrusion molding being stretched out into a thick tube shape in a heated state and thereafter cooled. The thermal contraction tube 40 obtained in this manner has a shape memory characteristic of contracting to the unstretched thin tube shape when heated.

Also, as shown in FIG. 1, in the present embodiment, no adhesion portion is provided between the covering portion 4 and the conductor portion 1. That is, the covering portion 4 and the conductor portion 1 are not adhered. Thus, in the molded portion-equipped electrical wire 100, the conductor portion 1 can move in the extension direction of the conductor portion 1 in the covering portion 4. In this case, it is possible to suppress a case in which the flexibility of the conductor portion 1 is inhibited by the adhesion portion.

Also, here, a gap 111 is formed between the covering portion 4 and the conductor portion 1. That is, the covering portion 4 is not in close contact with the conductor portion 1. For this reason, the flexibility of the conductor portion 1 is not inhibited. Also, in this case, it is conceivable that the gap between the covering portion 4 and the conductor portion 1 is formed over the entire portion between the molded portion 3 provided on both sides of the conductor portion 1, for example.

In order to achieve the above-described state, here, for example, it is conceivable to use, as the covering portion 4, a thermal contraction tube 40 having an inner diameter that is larger than the outer diameter of the conductor portion 1 in its maximally contracted state. Note that as another example, it is also conceivable that a gap is formed between the covering portion 4 and the conductor portion 1 by adjusting the amount of time and temperature for heating the thermal contraction tube 40, or the like.

Manufacturing Method

Next, a method for manufacturing the molded portion-equipped electrical wire 100 will be described with reference to FIGS. 1 to 3. The method for manufacturing the molded portion-equipped electrical wire 100 includes a connection step, a molding step, a level difference forming member attachment step, and a covering portion forming step.

The connection step is a step of connecting the terminal 2 to an end portion of the linear conductor portion 1. Here, a crimping task of crimping the first connection portion 21 of the terminal 2 and the end portion of the conductor portion 1 is performed.

In the present embodiment, the molding step is performed next. The molding step is a step of molding the molded portion 3 that covers the connection portion of the conductor portion 1 and the terminal 2 such that the terminal 2 protrudes from one end side and the conductor portion 1 protrudes from the other end side. Here, in a state in which the portion at which the terminal 2 and the conductor portion 1 are connected is set in a predetermined mold, melted resin is injected into the mold. Then, due to the resin in the mold solidifying, the molded portion 3 covering the portion at which the terminal 2 and the conductor portion 1 are connected is formed.

In the present embodiment, the level difference forming member attachment step is performed next. The level difference forming member attachment step is a step of providing the level difference forming member 6 on the outer circumferential surface of the molded portion 3. Here, as shown in FIG. 3, the level difference forming member 6 is provided on the outer circumferential surface of the second portion 36 of the molded portion 3. For example, it is conceivable that the terminal 2 and the molded portion 3 are inserted through the level difference forming member 6 in a state in which the level difference forming member 6 is elastically deformed so as to expand its inner diameter, and thereafter the level difference forming member 6 is elastically reverted. In this case, even if the first portion 35 of the molded portion 3 has a larger diameter than the second portion 36, the level difference forming member 6 can easily be retrofitted to the second portion 36 of the molded portion 3. Of course, it is also conceivable to pass the level difference forming member 6 through the conductor portion 1 before the molding step, and attach the level difference forming member 6 to the second portion 36 of the molded portion 3 from the other end side after the molding step.

In the present embodiment, the covering portion forming step is performed next. The covering portion forming step is a step of causing the thermal contraction tube 40 to contract, and obtaining the covering portion 4 that covers the periphery of the molded portion 3 and the conductor portion 1. In the covering portion forming step, the thermal contraction tube 40 is caused to contract such that the end portion of the contracted thermal contraction tube 40 is caught on the level difference portion S that is formed due to the level difference forming member 6 being provided. Here, in a state in which the level difference forming member 6 is provided on the second portion 36, the portion on the other end side of the molded portion 3, the conductor portion 1, and the level difference forming member 6 are arranged in the thermal contraction tube 40 as shown in FIG. 3. At this time, the portion on the other end side of the molded portion 3, the conductor portion 1, and the level difference forming member 6 are arranged in the thermal contraction tube 40 such that the end portion of the thermal contraction tube 40 on the molded portion 3 side is located on the one end side with respect to the level difference forming member 6.

More specifically, the molded portion 3, the conductor portion 1, and the level difference forming member 6 are arranged such that the end portion of the thermal contraction tube 40 on the molded portion 3 side is located on the one end side of the molded portion 3 with respect to the level difference forming surface 61 of the level difference forming member 6. Then, in this state, the thermal contraction tube 40 is heated. The heated thermal contraction tube 40 contracts and comes into close contact with the outer circumferential surfaces of the molded portion 3 and the level difference forming member 6.

Here, the heated thermal contraction tube 40 contracts in the radial direction and in the extension direction as well. At this time, if the thermal contraction tube 40 contracts excessively in the extension direction, there is concern that an inconvenience such as part of the portion to be covered being exposed will occur.

However, in the present embodiment, the thermal contraction tube 40 is heated in a state in which the edge portion of the thermal contraction tube 40 on the molded portion 3 side is located on the one end side with respect to the level difference forming member 6, and therefore the above-described inconvenience can be suppressed. That is, due to the thermal contraction tube 40 contracting in the radial direction, as shown in FIG. 2, the thermal contraction tube 40 comes into close contact with the outer circumferential surface of the molded portion 3 and the outer circumferential surface of the level difference forming member 6. Here, if the thermal contraction tube 40 attempts to contract in the extension direction, part of the thermal contraction tube 40 comes into contact with and is caught on the level difference forming surface 61. Accordingly, the end portion of the thermal contraction tube 40 on the molded portion 3 side is restricted from moving past the level difference portion S including the level difference forming surface 61, toward the other end side of the molded portion 3. Note that in the task of heating the thermal contraction tube 40, it is preferable that the end portion of the thermal contraction tube 40 is first heated, and thereafter an intermediate region of the thermal contraction tube 40 is heated. In this case, it is possible to enter a state in which the end portion of the thermal contraction tube 40 is more reliably caught on the level difference portion S.

In the state in which the end portion of the thermal contraction tube 40 is caught on the level difference portion S, the task of contracting the thermal contraction tube 40 ends, and thus the covering portion 4 that covers the periphery of the molded portion 3 and the conductor portion 1 can be formed, and the molded portion-equipped electrical wire 100 can be obtained. Note that according to the above description, in the present embodiment, the end portion of the covering portion 4 being caught on the level difference portion S in the molded portion-equipped electrical wire 100 means that the end portion of the covering portion 4 includes a portion that is in close contact with at least the level difference forming surface 61. Note that it is preferable that the end portion of the covering portion 4 is in close contact with both level difference forming members 6, which exist on both sides of the level difference portion S. More specifically, it is preferable that the outer circumferential surface of the portion of the second portion 36 located on the one end side with respect to the level difference forming surface 61, and the level difference forming surface 61 of the level difference forming member 6 are in close contact with surfaces facing opposite sides. In this case, the end portion of the covering portion 4 is more reliably caught on the level difference portion S.

Effect

In the present embodiment, the covering portion 4 that covers the periphery of the molded portion 3 and the conductor portion 1 is formed by heating the thermal contraction tube 40 in a state in which the molded portion 3 and the conductor portion 1 have been passed through the thermal contraction tube 40. In this case, the conductor portion 1 is insulated by the covering portion 4. Here, the end portion of the covering portion 4 is caught on the level difference portion S. For this reason, positional misalignment of the covering portion 4 with respect to the conductor portion 1 is suppressed, and the conductor portion 1 can be more reliably insulated by the covering portion 4. Accordingly, even if the end portion of the naked conductor portion 1 and the terminal 2 are connected without using the insulated electrical wire with an insulated and covered conductor portion 1, the conductor portion 1 can be more reliably insulated by the covering portion 4. According to the above, it is possible to eliminate the need for a step of removing the insulating covering in the molded portion-equipped electrical wire 100 including the insulated conductor portion 1.

Also, in the present embodiment, the level difference portion S is formed along the outer circumferential surface of the molded portion 3 and the level difference forming surface 61 of the level difference forming member 6, and therefore it is possible to prevent the shape of the level difference forming member 6 from becoming complicated or the level difference forming member 6 from increasing in size.

Also, in the present embodiment, the level difference forming member 6 is made of an elastic material, and therefore even if the outer dimension of the one end side is larger than that of the portion of the molded portion 3 on which the level difference forming member 6 is provided, the level difference forming member 6 can be easily retrofitted. Also, if the level difference forming member 6 is provided in a state of being expanded, it is possible to more reliably waterproof the space between the molded portion 3 and the level difference forming member 6 due to the level difference forming member 6 squeezing the molded portion 3.

Also, in the present embodiment, the level difference forming member 6 is formed into a ring shape so as to be continuous over the entire circumferential direction, and therefore it is possible to suppress the number of components to a lower number compared to the case where the level difference forming member 6 is two components or more.

Also, in the present embodiment, since a gap is formed between the conductor portion 1 and the covering portion 4, the conductor portion 1 can be made more bendable.

MODIFIED EXAMPLES

Next, modified examples of the molded portion-equipped electrical wire 100 according to the embodiment will be described.

First Modified Example

Figure 4:
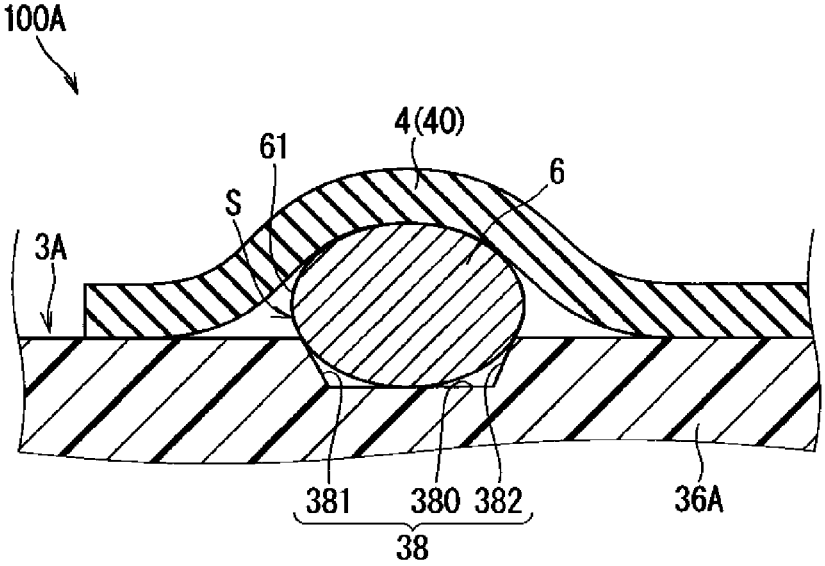
FIG. 4 is an enlarged cross-sectional view of part of a molded portion-equipped electrical wire according to a first modified example.

First, a molded portion-equipped electrical wire according to a first modified example will be described. FIG. 4 is an enlarged cross-sectional view of part of a molded portion-equipped electrical wire 100A according to a first modified example. Note that in FIG. 4, constituent elements that are the same as the constituent elements shown in FIGS. 1 to 3 are denoted by the same reference numerals thereas.

As shown in FIG. 4, in the molded portion-equipped electrical wire 100A of the present example, the level difference forming member 6 fits into a positioning recess 38 formed on the outer circumferential surface of a molded portion 3A.

The positioning recess 38 is formed along the circumferential direction of the molded portion 3A. The positioning recess 38 is formed so as to recess inward from the outer circumferential surface side of the molded portion 3A. More specifically, the positioning recess 38 is formed in a second portion 36A. The positioning recess 38 is formed so as to recess inward by less than the height of the level difference forming member 6. Accordingly, the outer circumferential side portion of the level difference forming member 6 that fits into the positioning recess 38 protrudes outward from the positioning recess 38 and can form a level difference.

The positioning recess 38 need only be formed into a shape into which a surface (inner circumferential surface) of the level difference forming member 6 on the molded portion 3A side can fit. In the present example, as shown in FIG. 4, the positioning recess 38 includes a bottom surface 380 that forms the bottom portion of the positioning recess 38 and conforms to the circumferential direction of the molded portion 3A, a first wall surface 381 that is continuous with the bottom surface 380 on one end side of the molded portion 3A, and a second wall surface 382 that is continuous with the bottom surface 380 on the other end side of the molded portion 3A. Here, the bottom surface 380 is formed extending along the extension direction of the molded portion 3A. Also, the first wall surface 381 and the second wall surface 382 are formed so as to be inclined with respect to the bottom surface 380. Note that as another example of the positioning recess 38, a case is also conceivable in which the angle formed by the first wall surface 381, the second wall surface 382, and the bottom surface 380 is 90 degrees. Also, as another aspect, a case is conceivable in which the first wall surface 381, the second wall surface 382, and the bottom surface 380 are connected by curving surfaces, or the like. Also, a case is conceivable in which the first wall surface 381 and the second wall surface 382 are connected without using the bottom surface 380, that is, the positioning recess 38 is a V-shaped recess formed along the circumferential direction of the molded portion 3A or the like.

According to this kind of molded portion-equipped electrical wire 100A, it is possible to prevent the level difference forming member 6 from becoming positionally misaligned with respect to the molded portion 3A during contraction of the thermal contraction tube 40 or the like. Also, it is possible to prevent the orientation of the level difference forming member 6 with respect to the molded portion 3A from curving during contraction of the thermal contraction tube 40 or the like, that is, it is possible to prevent part of the level difference forming member 6 in the circumferential direction from becoming misaligned in the extension direction of the molded portion 3A. Accordingly, it is possible to achieve stabilization of the product quality.

Second Modified Example

Figure 5:
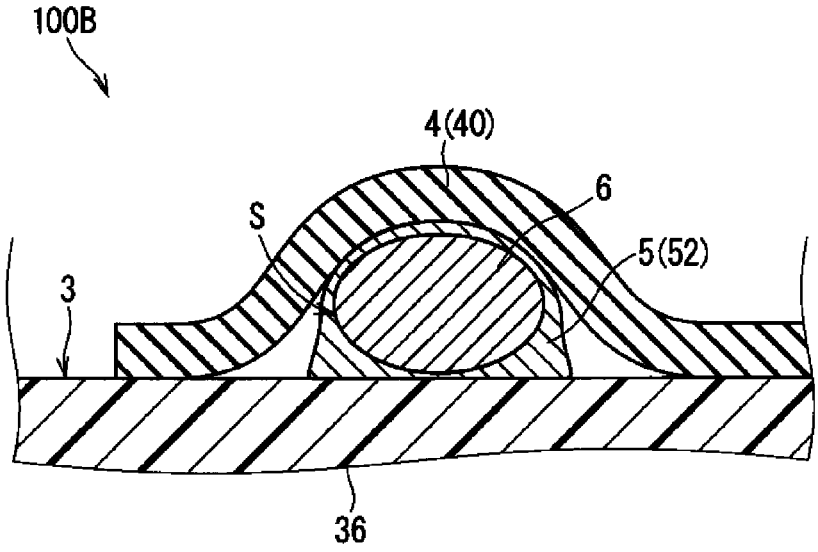
FIG. 5 is an enlarged cross-sectional view of part of a molded portion-equipped electrical wire according to a second modified example.

Next, a molded portion-equipped electrical wire according to a second modified example will be described. FIG. 5 is an enlarged cross-sectional view of part of a molded portion-equipped electrical wire 100B according to the second modified example. Note that in FIG. 5, constituent elements that are the same as the constituent elements shown in FIGS. 1 to 4 are denoted by the same reference numerals thereas.

As shown in FIG. 5, the molded portion-equipped electrical wire 100B of the present example further includes an adhesion portion 5 ("adhesion") provided on the periphery of the level difference forming member 6.

In the molded portion-equipped electrical wire 100B, the adhesion portion 5 fills the space between the covering portion 4 and the level difference forming member 6 and the space between the molded portion 3 and the level difference forming member 6. Accordingly, a case is suppressed in which liquid such as water travels along the outer circumferential surface of the molded portion 3 and enters the conductor portion 1 side of the covering portion 4. For example, it is conceivable that a polyamide-based, modified olefin-based, or polyester-based adhesive 52 is employed as the adhesion portion 5. It is conceivable that a hot-melt adhesive is employed as the adhesion portion.

In the present example, before being attached to the second portion 36, the level difference forming member 6 is coated in advance with a thermoplastic adhesive 52. That is, the softened adhesive 52 is applied to the circumferential surface of the level difference forming member 6, and thereafter the adhesive 52 is hardened. For example, by submerging the level difference forming member 6 in a container containing the softened adhesive 52, the level difference forming member 6 can be coated with the adhesive 52. Then, the thermal contraction tube 40 is heated in a state in which the level difference forming member 6 with the hardened thermoplastic adhesive 52 is provided on the second portion 36 and the uncontracted thermal contraction tube 40 is provided. The thermal contraction tube 40 contracts and the adhesive 52 softens due to the heat, and eventually the adhesion portion 5 is formed due to the inner circumferential surface of the thermal contraction tube 40 and the outer circumferential surface of the second portion 36 being adhered to the adhesive 52 in the periphery of the level difference forming member 6. Accordingly, the adhesion portion 5 is interposed between the covering portion 4, which is a member obtained due to the thermal contraction tube 40 contracting, and the level difference forming member 6, and between the molded portion 3 and the level difference forming member 6, whereby it is possible to waterproof the molded portion-equipped electrical wire 100B.

Note that as another example, a case is also conceivable in which the adhesive 52 is provided in advance on the outer circumferential surface of the second portion 36 and the inner circumferential surface of the uncontracted thermal contracted tube 40 instead of being provided in advance on the level difference forming member 6, or the like.

According to this kind of molded portion-equipped electrical wire 100B, it is possible to more reliably waterproof the space between the covering portion 4 and the level difference forming member 6 and the space between the molded portion 3 and the level difference forming member 6 by including the adhesion portion 5.

Third Modified Example

Figure 6:
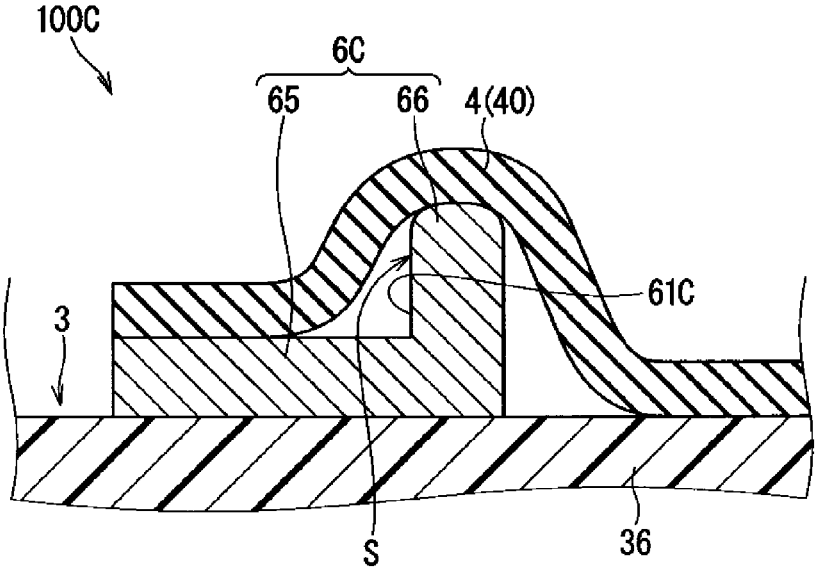
FIG. 6 is an enlarged cross-sectional view of part of a molded portion-equipped electrical wire according to a third modified example.

Next, a molded portion-equipped electrical wire according to a third modified example will be described. FIG. 6 is an enlarged cross-sectional view of part of a molded portion-equipped electrical wire 100C according to the third modified example. Note that in FIG. 6, constituent elements that are the same as the constituent elements shown in FIGS. 1 to 5 are denoted by the same reference numerals thereas.

As shown in FIG. 6, in the molded portion-equipped electrical wire 100C of the present example, the level difference forming member 6C includes a small diameter portion 65 and a large diameter portion 66, and forms a level difference portion S that the end portion of the thermal contraction tube 40 is caught on, between the small diameter portion 65 and the large diameter portion 66.

In the present example, the small diameter portion 65 is formed into a cylindrical shape. The large diameter portion 66 is continuous with the small diameter portion 65 and is formed into a cylindrical shape with a larger diameter than the small diameter portion 65. The inner diameter of the small diameter portion 65 and the inner diameter of the large diameter portion 66 are equal, and the outer diameter of the large diameter portion 66 is formed larger than the outer diameter of the small diameter portion 65. The level difference forming member 6C is provided on the second portion 36 such that the small diameter portion 65 is located on the one end side with respect to the large diameter portion 66. The surface facing the one end side of the large diameter portion 66 forms the level difference forming surface 61C. The level difference forming surface 61C is orthogonal to the outer circumferential surface of the small diameter portion 65. The dimension in the axial direction of the small diameter portion 65 is set to be of such a degree that a catching margin of the thermal contraction tube 40 can be ensured. That is, the dimension is set such that it is possible to perform contraction such that the portion of the thermal contraction tube 40 on the one end side with respect to the large diameter portion 66 comes into close contact with the outer circumferential surface of the small diameter portion 65.

In the present example as well, it is possible to eliminate the need for a step of removing the insulating covering in the molded portion-equipped electrical wire 100C including the insulated conductor portion 1.

Fourth Modified Example

Figure 7:
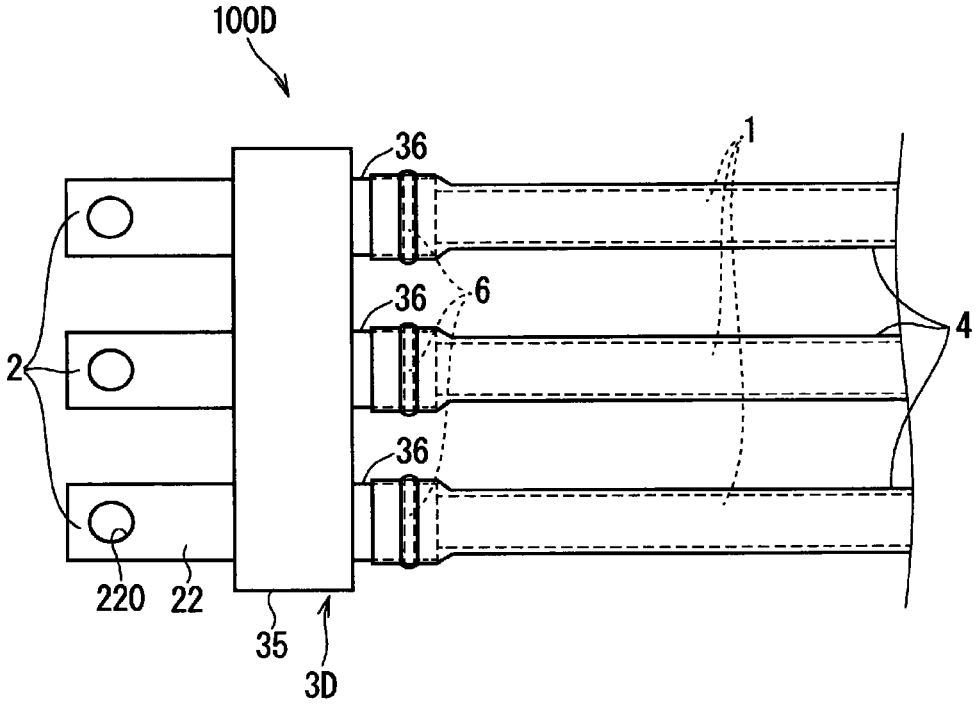
FIG. 7 is an enlarged cross-sectional view of part of a molded portion-equipped electrical wire according to a fourth modified example.

Next, a molded portion-equipped electrical wire according to a fourth modified example will be described. FIG. 7 is an enlarged cross-sectional view of part of a molded portion-equipped electrical wire 100D according to the fourth modified example. Note that in FIG. 7, constituent elements that are the same as the constituent elements shown in FIGS. 1 to 6 are denoted by the same reference numerals thereas.

As shown in FIG. 7, the molded portion-equipped electrical wire 100D of the present example includes multiple (here, three) conductor portions 1 and multiple (here, three) terminals 2. Also, the connection portions of the three conductor portions 1 and the three terminals 2 are covered by one molded portion 3D.

The molded portion 3D of the present example differs from the above-described embodiment in that it includes one first portion 35 and three second portions 36. The three second portions 36 are formed protruding from the one first portion 35 so as to cover the peripheries of the three conductor portions 1. Also, by providing a level difference forming member 6 on each of the three second portions 36, the level differences S are formed.

Also, the molded portion-equipped electrical wire 100D includes three covering portions 4. As shown in FIG. 7, the three covering portions 4 respectively cover the three second portions 36 and the conductor portions 1 extending therefrom.

In the present example as well, it is possible to eliminate the need for a step of removing the insulating covering in the molded portion-equipped electrical wire 100D including the insulated conductor portion 1.

Fifth Modified Example

Figure 8:
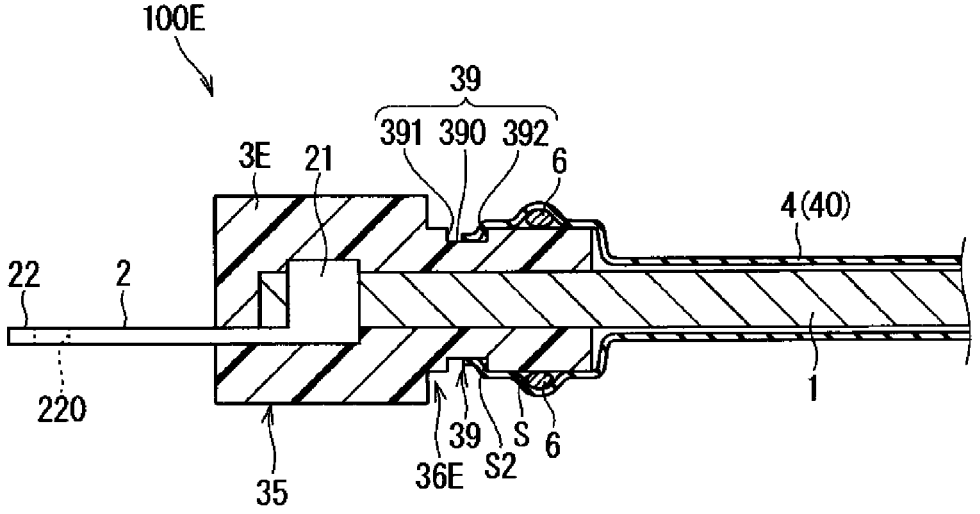
FIG. 8 is an enlarged cross-sectional view of part of a molded portion-equipped electrical wire according to a fifth modified example.

Next, a molded portion-equipped electrical wire 100E according to a fifth modified example will be described. FIG. 8 is an enlarged cross-sectional view of part of the molded portion-equipped electrical wire 100E according to the fifth modified example. Note that in FIG. 8, constituent elements that are the same as the constituent elements shown in FIGS. 1 to 7 are denoted by the same reference numerals thereas.

As shown in FIG. 8, the molded portion-equipped electrical wire 100E of the present example includes a second level difference portion S2 that is formed on the outer circumferential surface of the molded portion 3E.

Here, a recess 39 is formed on the one end side with respect to the portion of the outer circumferential surface of the second portion 36E on which the level difference forming member 6 is provided. The recess 39 includes a bottom surface 390 that forms a bottom portion of the recess 39 and conforms to the circumferential direction of the molded portion 3E, a first wall surface 391 that is continuous with the bottom surface 390 on the one end side of the molded portion 3E, and a second wall surface 392 that is continuous with the bottom surface 390 on the other end side of the molded portion 3E. The portion of the recess 39 including the second wall surface 392 forms a second level difference portion S2. Also, the end portion of the thermal contraction tube 40 is caught on the level difference portion S. Furthermore, the end portion of the thermal contraction tube 40 is caught on the second level difference portion S2 on the one end side with respect to the level difference portion S.

According to this kind of molded portion-equipped electrical wire 100E, the end portion of the thermal contraction tube 40 is caught on the two level difference portions S and S2, and therefore the thermal contraction tube 40 is less likely to become positionally misaligned.

Other Modified Examples

Although the level difference forming member 6 has been described above as being formed into a continuous ring shape, this is not essential. The level difference forming member may form a ring shape due to multiple components being combined.

Also, although the level difference forming member 6 has been described above as being formed continuously over the entirety of the circumferential direction of the molded portion 3, this is not essential. The level difference forming member 6 may be formed on only part of the molded portion 3 in the circumferential direction. Also, the level difference forming member 6 may be formed intermittently over the entirety of the circumferential direction of the molded portion 3. The level difference forming member 6 may be interspersed in the circumferential direction of the molded portion 3.

Also, although the level difference forming member 6 has been described above as being made of an elastic material, this is not essential. The level difference forming member may be made of resin, metal, or the like. In this case, it is conceivable that the level difference forming member is attached to the molded portion 3 due to being constituted by multiple components as described above, for example. Also, for example, it is conceivable that the level difference forming member is attached to the molded portion 3 due to being formed with a large radius and then being crimped to have a smaller radius, or the like.

Also, although it has been described above that there is a gap between the covering portion 4 and the conductor portion 1, this is not essential. The covering portion 4 and the conductor portion 1 may be in close contact with each other, or the adhesion portion may be interposed between the covering portion 4 and the conductor portion 1. In the former case, for example, the covering portion 4 is formed due to the thermal contraction tube 40, which has a contracted diameter that is equal to or smaller than the diameter of conductor portion 1, contracting. In the latter case, for example, the covering portion 4 and the adhesion portion are formed due to the thermal contraction tube 40, inside of which a layer of adhesive is formed, contracting. More specifically, the covering portion 4 and the adhesion portion are formed due to a waterproofing tube, which has a double-layer structure including the thermal contraction tube 40 and a layer of thermoplastic adhesive formed on the inside surface of the thermal contraction tube 40, being heated and contracting. As the adhesive on the inner side of the thermal contraction tube 40, it is conceivable to use a polyamide-based, a modified olefin-based, or a polyester-based hot-melt adhesive, or the like.

Note that the configurations described using the above-described embodiment and modified examples can be combined as appropriate, as long as they do not contradict each other.

Although the disclosure has been described in detail above, the above-described disclosure is in all aspects exemplary and the disclosure is not limited thereto. It is to be understood that countless modified examples that have not been illustrated can be envisioned without departing from the scope of the disclosure.

The invention claimed is:

1. A molded portion-equipped electrical wire comprising:
a conductor;
a terminal connected to an end of the conductor;
a mold covering a portion at which the conductor and the terminal are connected such that the terminal protrudes from one end side of the mold and the conductor protrudes from another end side of the mold;
an insulating covering that covers a periphery of the mold and the conductor and is obtained due to a thermal contraction tube contracting; and
a body that is provided on a radially outer circumferential surface of the mold and includes a level difference forming surface facing the one end side,
wherein an end of the covering is caught on a level difference portion formed by the level difference forming surface, and
the body is made of an elastic material.

2. A molded portion-equipped electrical wire comprising:
a conductor;
a terminal connected to an end of the conductor;
a mold covering a portion at which the conductor and the terminal are connected such that the terminal protrudes from one end side of the mold and the conductor protrudes from another end side of the mold;
an insulating covering that covers a periphery of the mold and the conductor and is obtained due to a thermal contraction tube contracting; and
a body that is provided on a radially outer circumferential surface of the mold and includes a level difference forming surface facing the one end side,
wherein an end of the covering is caught on a level difference portion formed by the level difference forming surface, and
the body fits into a positioning recess formed in the outer circumferential surface of the mold.

3. A molded portion-equipped electrical wire comprising:
a conductor;
a terminal connected to an end of the conductor;
a mold covering a portion at which the conductor and the terminal are connected such that the terminal protrudes from one end side of the mold and the conductor protrudes from another end side of the mold;
an insulating covering that covers a periphery of the mold and the conductor and is obtained due to a thermal contraction tube contracting; and
a body that is formed separately from the mold, is provided on a radially outer circumferential surface of the mold, and includes a level difference forming surface facing the one end side,
wherein an end of the covering is caught on a level difference portion formed by the level difference forming surface.

4. The molded portion-equipped electrical wire according to claim 1, further comprising an adhesion that is provided on the periphery of the body and fills a space between the covering and the body and a space between the mold and the body.

5. The molded portion-equipped electrical wire according to claim 1, wherein the body is formed into a ring shape so as to be continuous over an entire circumferential direction.

6. The molded portion-equipped electrical wire according to claim 1, wherein a gap is formed between the conductor and the covering.

7. The molded portion-equipped electrical wire according to claim 2, further comprising an adhesion that is provided on the periphery of the body and fills a space between the covering and the body and a space between the mold and the body.

8. The molded portion-equipped electrical wire according to claim 2, wherein the body is formed into a ring shape so as to be continuous over an entire circumferential direction.

9. The molded portion-equipped electrical wire according to claim 2, wherein a gap is formed between the conductor and the covering.

10. The molded portion-equipped electrical wire according to claim 3, further comprising an adhesion that is provided on the periphery of the body and fills a space between the covering and the body and a space between the mold and the body.

11. The molded portion-equipped electrical wire according to claim 3, wherein the body is formed into a ring shape so as to be continuous over an entire circumferential direction.

12. The molded portion-equipped electrical wire according to claim 3, wherein a gap is formed between the conductor and the covering.

* * * * *